US008303374B2

(12) United States Patent
Thysell et al.

(10) Patent No.: US 8,303,374 B2
(45) Date of Patent: Nov. 6, 2012

(54) CARRIER PLATE HOLDING AN ABRADING ELEMENT AND ABRADING PLATE

(75) Inventors: Hakan Thysell, Soderkoping (SE); Karl Thysell, Soderkoping (SE); Lars Olsen, Kalmar (SE)

(73) Assignee: HTC Sweden AB, Söderköping (SE)

( * ) Notice: Subject to any disclaimer, the term of this patent is extended or adjusted under 35 U.S.C. 154(b) by 10 days.

(21) Appl. No.: 12/618,483

(22) Filed: Nov. 13, 2009

(65) Prior Publication Data

US 2010/0062688 A1 Mar. 11, 2010

Related U.S. Application Data

(63) Continuation of application No. 10/560,078, filed as application No. PCT/SE2004/000905 on Jun. 10, 2004, now Pat. No. 7,670,208.

(30) Foreign Application Priority Data

Jun. 11, 2003 (SE) ..... 0301709

(51) Int. Cl.
*B24B 7/00* (2006.01)

(52) U.S. Cl. ..... 451/41; 451/353; 451/548

(58) Field of Classification Search ..... 125/3, 25, 125/9; 451/353, 350, 359, 548, 543, 41
See application file for complete search history.

(56) References Cited

U.S. PATENT DOCUMENTS

| | | | | |
|---|---|---|---|---|
| 1,470,957 | A | 10/1923 | Cavicchi | |
| 2,842,904 | A | 7/1958 | Ralys | |
| 3,291,583 | A * | 12/1966 | Lindblad | 51/293 |
| 4,641,628 | A * | 2/1987 | deKok | 125/15 |
| 5,076,023 | A | 12/1991 | Saguchi | |
| 5,567,503 | A | 10/1996 | Sexton et al. | |
| 5,683,143 | A | 11/1997 | Peterson et al. | |
| 7,192,339 | B1 | 3/2007 | Harding | |

FOREIGN PATENT DOCUMENTS

| | | |
|---|---|---|
| DE | 1 047 054 | 12/1958 |
| DE | 1 127 745 | 4/1962 |
| DE | 1 949 505 | 4/1971 |
| DE | 7232443 | 12/1972 |
| DE | 201 20 137 U1 | 2/2002 |
| FI | 30 346 | 3/1960 |
| JP | 5-41668 | 6/1993 |
| JP | 6-134675 | 5/1994 |
| JP | 11-151675 | 6/1999 |
| KR | 1993-0023113 | 12/1993 |
| NO | 315191 B | 7/2003 |
| WO | PCT/SE93/00865 | 4/1994 |
| WO | WO 2004/108352 A3 | 12/2004 |

OTHER PUBLICATIONS

Communication of a Notice of Opposition, Jul. 2, 2008 re: EP 1 638 731 B1 (English language translation). International Type Search Report for Swedish application 0301709-2.
Office Action issued Feb. 11, 2011, in Korean Patent Application No. 10-2005-7022816 (with English translation).

* cited by examiner

*Primary Examiner* — Robert Rose
(74) *Attorney, Agent, or Firm* — Oblon, Spivak, McClelland, Maier & Neustadt, L.L.P.

(57) ABSTRACT

The invention concerns a carrier plate holding an abrading element, for detachable mounting on a rotatably mounted abrading plate driven during use, for abrading stone or concrete floors, which carrier plate has sides which form an acute angle with each other. The sides have flanges which are formed for surrounding engagement with a shoulder arranged on the abrading plate so that the carrier plate can be fixed on the abrading plate with an engagement based on form and friction.

15 Claims, 2 Drawing Sheets

CARRIER PLATE HOLDING AN ABRADING ELEMENT AND ABRADING PLATE

CROSS-REFERENCE TO RELATED APPLICATION

The present application is based upon and claims a benefit to U.S. application Ser. No. 10/560,078 entitled "Carrier Plate Holding an Abrading Element and Abrading Plate" and filed on Dec. 28, 2006, the entire contents of which are incorporated herein by reference.

BACKGROUND

1. Field of the Invention

The present invention concerns a carrier plate holding an abrading element and an abrading plate device according to the preamble of the respective independent claims.

2. Description of the Background

A machine, preferably for abrading stone and concrete floors, is known for example from PCT/SE93/00865. The abrading element, fixed on a carrier plate which in turn is detachably mounted on the abrading plate, must be considered a consumable. Changing the abrading element is labor-intensive and time-consuming, and adversely affects the production time of the abrading machine.

Examples of known devices for detachable mounting of abrading elements on abrading discs are shown in DE-1 127 745, U.S. Pat. No. 1,470,957 and U.S. Pat. No. 5,076,023.

SUMMARY

The object of the present invention is to produce a device of the type described initially which facilitates the replacement of the abrading element and hence contributes to a better working environment and increased production.

The invention is defined by the enclosed independent claim. Embodiments arise from the enclosed dependent claims and the following descriptions and enclosed drawings.

Thus a carrier plate holding an abrading element is produced, for detachable mounting on a rotatably mounted abrading plate driven during use, for abrading stone or concrete floors, which carrier plate has sides which form an acute angle with each other. The carrier plate is characterized in that the sides have flanges which are designed for surrounding engagement with a shoulder arranged on the abrading plate so that the carrier plate can be fixed on the abrading plate with an engagement based on form and friction.

An abrading plate is also produced for abrading stone or concrete floors, which abrading plate is rotatably mounted and driven during use and formed for detachable mounting of at least one carrier plate holding an abrading element. The abrading plate is characterized by a shoulder arranged on the abrading plate which has side edges forming an acute angle with each other and which is designed for engagement with flanges arranged on the carrier plate so that the carrier plate by surrounding engagement can be fixed on the abrading plate in an engagement based on form and friction.

The invention thus achieves the simplified mounting of carrier plates on the abrading plate, which mounting is also quick to both establish and release.

As a particular characteristic of the invention shows, because of the acute angle between the undercut groove and naturally also between the corresponding edges shaped complementary to the groove on the carrier plate, the engagement between the groove and the carrier plate edges can be established and released very quickly.

Carrier plates according to the invention also have the advantage that they can be produced at relatively low cost.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
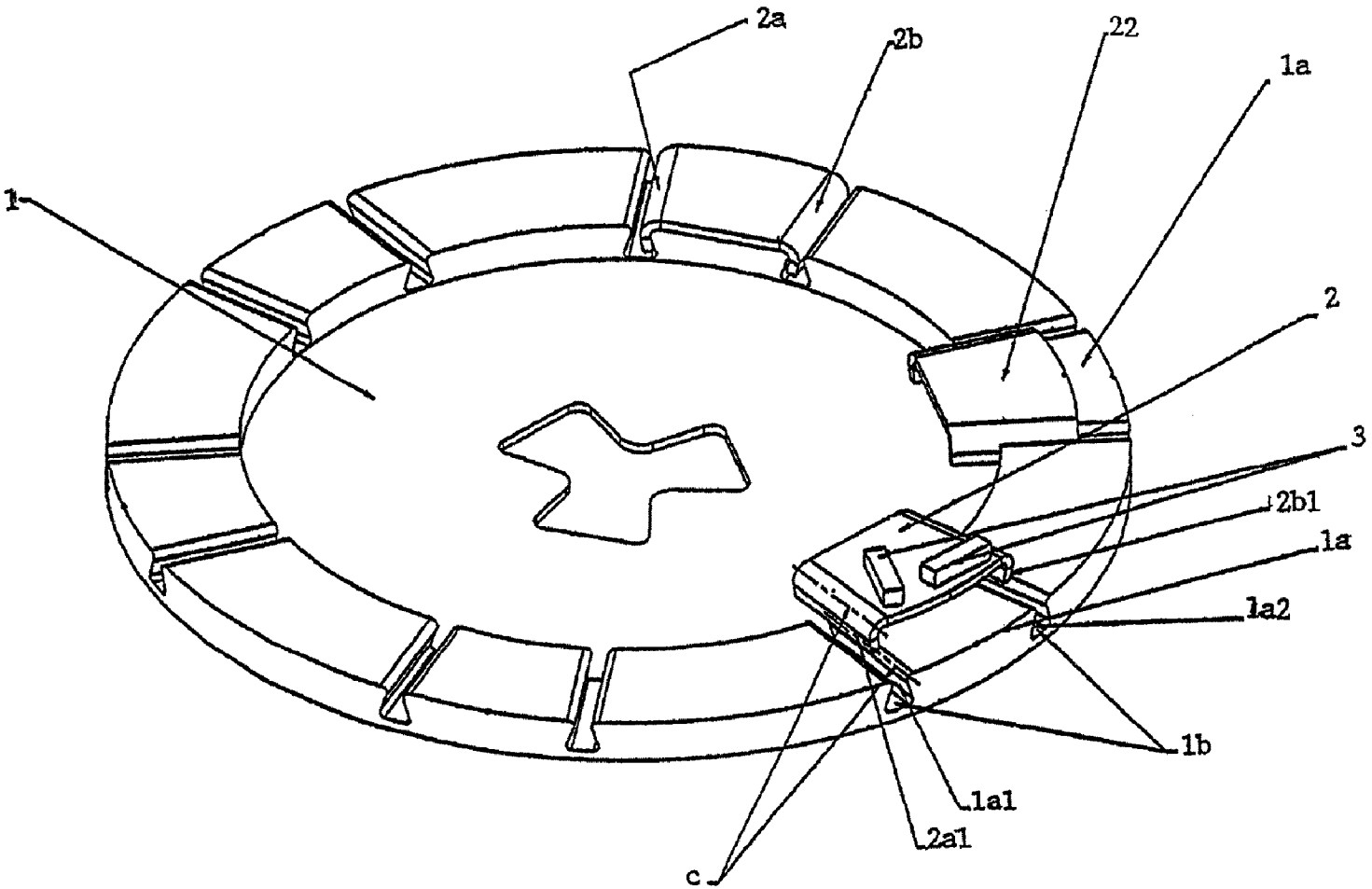
FIG. 1 shows a preferred embodiment of the device according to the invention.

On the drawing 1 indicates an abrading plate which is mounted rotatably and for abrasion is driven by a motor as is explained in more detail in the patent publication cited initially. On the abrading plate is detachably fixed a number of carrier plates 2 positioned according to a predetermined pattern, each supporting a number of abrading segments 3 placed in a predetermined manner on the carrier plate 2.

The carrier plates 2 each have two sides 2*a*, 2*b* which form an acute angle with each other and on the abrading plate 1 are a number of elements 1*a* positioned according to the said pattern and complementary to the sides 2*a*, 2*b* of the respective carrier plate. The sides 2*a*, 2*b* and the element edges stand in an undercut relationship to each other and are directed so that a radius from the centre of the abrading plate divides the acute angle pointing towards the abrading plate centre 1 into two essential equal parts.

The sides 2*a*, 2*b* of the carrier plate 2 are formed with downward and inward pointing flanges 2*a*1, 2*b*1, where the transition between the plane of the abrading plate and the plane of flanges 2*a*1, 2*b*1 is rounded so that for reasons of production and strength the flanges are curved about an imaginary axis c parallel to the sides 2*a*, 2*b* of the carrier plate 2. In the preferred embodiment shown in FIG. 1, the said complementary-shaped element 1 comprises a shoulder 1*a* formed by a radial groove 1*b* produced in the abrading plate 1, the side edges 1*a*1, 1*a*2 of which are intended to stand in engagement with the sides 1*a*1, 1*a*2 surrounding the flanges 2*a*1, 2*b*1. The tip of the acute angle points radially inwards so that the forces occurring on abrasion prevent the carrier plate 2 from leaving the protrusion 1*a*. This achieves the advantage that the carrier plate 2 is held on the protrusion 1*a* with an engagement based on friction.

Figure 2:
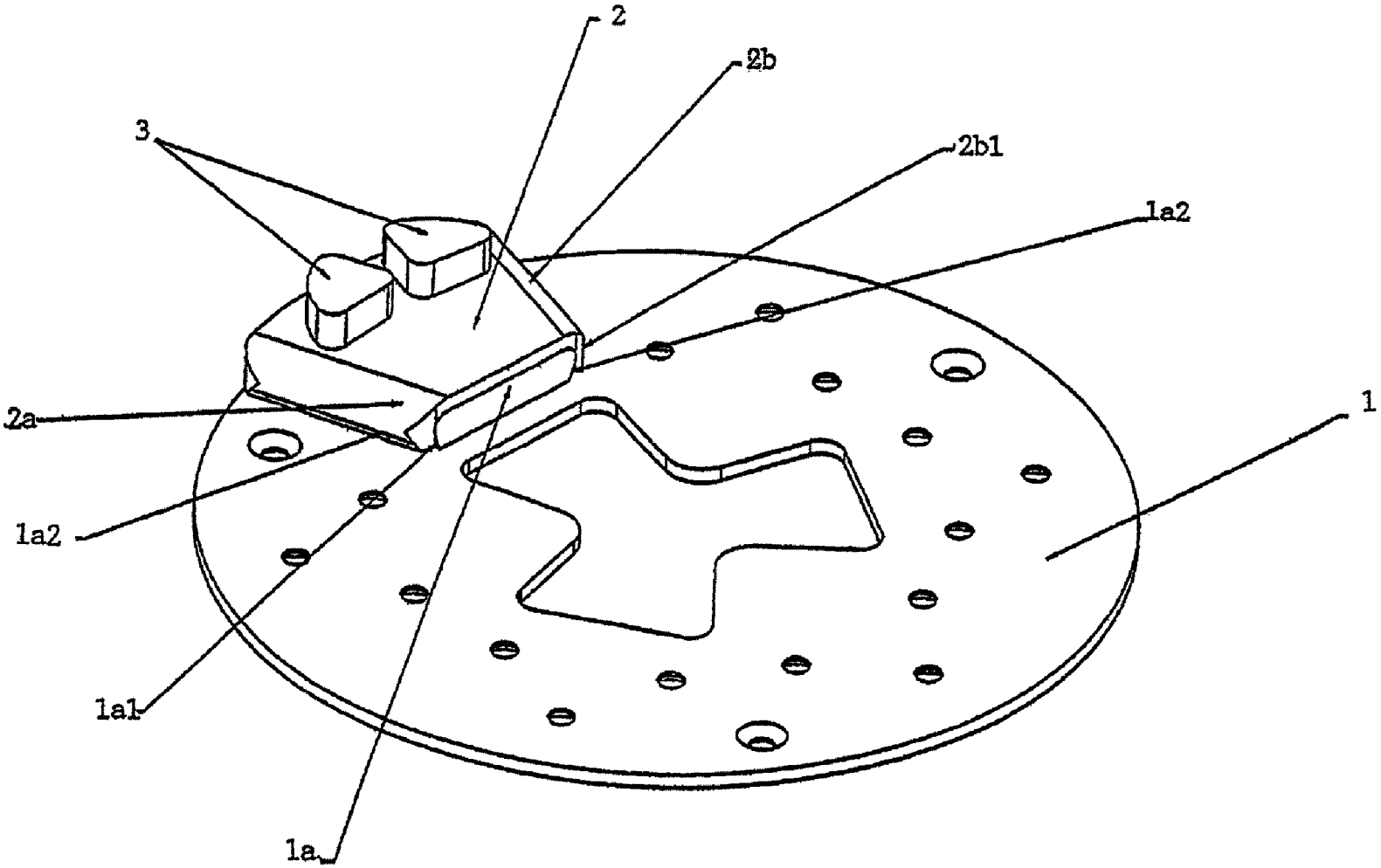
FIG. 2 shows an alternative embodiment of the invention.

In the embodiment in FIG. 2 the element 1*a* comprises protrusions projecting from the abrading plate 1, otherwise the statements above relating to the embodiment in FIG. 1 apply accordingly.

The invention claimed is:

1. A carrier plate detachably mounted on a rotatably mounted abrading plate driven during use to abrade stone or concrete floors, the carrier plate comprising:

a top surface having a first edge shorter than an opposing second edge;

at least one abrading element affixed to the top surface;

a first side arranged on a third edge of the top surface;

a second side arranged on a fourth edge of the top surface, the fourth edge opposing the third edge; and two flanges, each flange arranged on a respective one of the first and second sides to surround a shoulder arranged on the abrading plate, wherein the shoulder has side edges that are undercut to correspond to the two flanges so that the carrier plate can be fixed on the abrading plate with an engagement based only on form and friction, wherein the third and fourth edges, as seen in a plane defined by the top surface, form an acute angle with each other, and wherein transitions between the plane defined by the top surface and respective planes containing outwardly facing surfaces of the flanges are rounded so that the flanges are curved about a respective imaginary axis parallel to the respective side edge of the carrier.

2. The carrier plate according to claim 1, wherein the carrier plate can be fixed on the abrading plate by movement in a direction away from an abrading plate center.

3. The carrier plate according to claim 1, wherein the carrier plate includes a mounting face on which the abrading element is arranged, a surface area of the mounting face being greater than a cross-sectional area of a surface of the abrading element that is parallel to the mounting face.

4. The carrier plate according to claim 1, wherein the carrier plate includes a mounting face on which the abrading element is arranged, said mounting face being at least partially exposed.

5. The carrier plate according to claim 1, wherein the carrier plate carries at least two abrading elements spaced apart.

6. An abrading plate rotatably mounted and driven during use to abrade stone or concrete floors, the abrading plate having at least one carrier plate detachably mounted thereon, the carrier plate having at least one abrading element, the abrading plate comprising:

at least one undercut shoulder, each undercut shoulder including a first side arranged to form an acute angle with respect to a second side, the acute angle being bisected by a line from the center of the abrading plate to the edge of the abrading plate, each undercut shoulder being provided to engage with flanges arranged on the carrier plate so that the carrier plate, by surrounding engagement, can be fixed on the abrading plate based on form and friction without fasteners.

7. The abrading plate according to claim 6, wherein the shoulder is formed by a radial groove produced in the abrading plate.

8. The abrading plate according to claim 6, wherein the shoulder forms a protrusion projecting from a surface of the abrading plate parallel to a plane of rotation.

9. An abrading device rotatably mounted and driven during use to abrade stone or concrete floors, comprising:

a carrier plate to hold at least one abrading element for abrading stone or concrete floors, the carrier plate including, a top surface having a first edge shorter than an opposing second edge, at least one abrading element affixed to the top surface, a first side arranged on a third edge of the top surface, a second side arranged on a fourth edge of the top surface, the fourth edge opposing the third edge, and two flanges, each flange arranged on a respective one of the first and second sides, to surround a shoulder arranged on the abrading plate; and an abrading plate having an undercut shoulder including two sides, one side forming an acute angle with respect to the other side, the acute angle being bisected by a line from a center of the abrading plate to an edge of the abrading plate, wherein the undercut shoulder is provided to engage the flanges of the carrier plate so that the carrier plate, by surrounding engagement, can be detachably mounted on the abrading plate with an engagement based only on form and friction.

10. A system for abrading stone or concrete floors comprising:

a carrier plate to hold at least one abrading element for abrading the stone or concrete floors, the carrier plate including, a top surface having a first edge shorter than an opposing second edge, at least one abrading element affixed to the top surface, a first side arranged on a third edge of the top surface, a second side arranged on a fourth edge of the top surface, the fourth edge opposing the third edge, and two flanges, each flange arranged on a respective one of the first and second sides, to surround a shoulder arranged on the abrading plate;

an abrading plate having an undercut shoulder including two sides, one side forming an acute angle with respect to the other side, the acute angle being bisected by a line from a center of the abrading plate to an edge of the abrading plate, the undercut shoulder engaging the flanges of the carrier plate so that the carrier plate, by surrounding engagement, can be detachably mounted on the abrading plate with an engagement based only on form and friction; and a machine having the abrading plate mounted thereon, the machine including a motor to rotate the abrading plate to abrade the stone or concrete floor.

11. A method of abrading a stone or concrete floor, comprising:

providing a carrier plate to hold at least one abrading element for abrading the stone or concrete floors, the carrier plate including, a top surface having a first edge shorter than an opposing second edge, at least one abrading element affixed to the top surface, a first side arranged on a third edge of the top surface, a second side arranged on a fourth edge of the top surface, the fourth edge opposing the third edge, and two flanges, each flange arranged on a respective one of the first and second sides, to surround a shoulder arranged on the abrading plate;

detachably mounting the carrier plate on an abrading plate having an undercut shoulder including two sides, one side forming an acute angle with respect to the other side, the acute angle being bisected by a line from a center of the abrading plate to an edge of the abrading plate, the undercut shoulder engaging the flanges of the carrier plate an engagement based only on form and friction;

rotating the abrading plate with the carrier plate mounted thereon over the stone or concrete floor; and driving the abrading plate across the stone or concrete floor while rotating to abrade the stone or concrete floor.

12. The carrier plate according to claim 1, wherein the top surface extends beyond the at least one abrading element in a radial direction with respect to the abrading plate.

13. The carrier plate according to claim 12, wherein the top surface extends beyond the at least one abrading element in an inward radial direction relative to the abrading plate.

14. The carrier plate according to claim 13, wherein the top surface extends beyond the at least one abrading element in an outward radial direction relative to the abrading plate.

15. The carrier plate according to claim 1, wherein the at least one abrading element is spaced at a predetermined distance from both the first and second edges.

* * * * *